US010723537B2

(12) United States Patent
Son et al.

(10) Patent No.: US 10,723,537 B2
(45) Date of Patent: Jul. 28, 2020

(54) CARTRIDGE PUMP

(71) Applicant: DARIN CO., LTD., Changwon-si, Gyeongsangnam-do (KR)

(72) Inventors: Dae Sik Son, Changwon-si (KR); Ji Na Kim, Changwon-si (KR); Do Hoon Lee, Miryang-si (KR)

(73) Assignee: DARIN CO., LTD., Changwon-si (KR)

( * ) Notice: Subject to any disclaimer, the term of this patent is extended or adjusted under 35 U.S.C. 154(b) by 0 days.

(21) Appl. No.: 16/094,716

(22) PCT Filed: May 26, 2016

(86) PCT No.: PCT/KR2016/005546
§ 371 (c)(1),
(2) Date: Oct. 18, 2018

(87) PCT Pub. No.: WO2017/204381
PCT Pub. Date: Nov. 30, 2017

(65) Prior Publication Data

US 2019/0119028 A1 Apr. 25, 2019

(51) Int. Cl.

| | |
|---|---|
| ***B65D 81/32*** | (2006.01) |
| ***B65D 51/28*** | (2006.01) |
| ***A61J 1/20*** | (2006.01) |
| ***A61J 7/00*** | (2006.01) |

(52) U.S. Cl.
CPC ..... *B65D 81/3222* (2013.01); *A61J 1/2093* (2013.01); *A61J 7/0046* (2013.01); *B65D 51/2807* (2013.01); *B65D 51/2892* (2013.01)

(58) Field of Classification Search
CPC ... A61J 1/2093; B65D 25/08; B65D 51/2807; B65D 81/3211; B65D 51/2857; B65D 51/2864
USPC ..... 206/219–223
See application file for complete search history.

(56) References Cited

U.S. PATENT DOCUMENTS 5,380,087 A * 1/1995 Haber ..... A61M 5/2448 206/219
5,474,209 A * 12/1995 Vallet Mas ..... B65D 51/285 206/219
5,782,345 A * 7/1998 Guasch ..... B65D 41/3409 206/219
5,839,573 A * 11/1998 Morini ..... B65D 51/2864 206/221
5,967,309 A * 10/1999 Robles-Gonzalez ..... B65D 51/2892 206/221
7,261,226 B2 * 8/2007 Adams ..... B65D 47/244 206/221

(Continued)

FOREIGN PATENT DOCUMENTS

CN 202880051 U 4/2013
CN 104609025 A 5/2015

(Continued)

*Primary Examiner* — Chun Hoi Cheung
(74) *Attorney, Agent, or Firm* — BakerHostetler

(57) ABSTRACT

A cartridge pump according to the present invention includes: a housing unit connected to a container; a head unit rotatably provided in the housing unit; a storage unit provided in the head unit and having a storage space in which contents are stored; and a mixing operator configured to lead the contents in the storage unit into the container in cooperation with an operation of the head unit.

10 Claims, 7 Drawing Sheets

(56) References Cited

U.S. PATENT DOCUMENTS

| | | | | |
|---|---|---|---|---|
| 7,614,496 | B2 * | 11/2009 | Dvorak | B65D 41/3428 206/219 |
| 2004/0007481 | A1 * | 1/2004 | Kiser | B65D 51/2878 206/219 |
| 2005/0211579 | A1 * | 9/2005 | Makita | B65D 51/2842 206/219 |
| 2006/0283726 | A1 * | 12/2006 | McCloud | A45D 19/02 206/219 |
| 2010/0108715 | A1 * | 5/2010 | Santagiuliana | B65D 51/2835 222/81 |
| 2015/0217924 | A1 * | 8/2015 | Cho | B65D 51/2892 206/219 |
| 2015/0239638 | A1 * | 8/2015 | Lee | B65D 51/285 206/222 |

FOREIGN PATENT DOCUMENTS

| | | | |
|---|---|---|---|
| JP | 2010-6405 | A | 1/2010 |
| JP | 2013-188290 | A | 9/2013 |
| KR | 20040011409 | A | 2/2004 |
| KR | 2005-0067805 | A | 7/2005 |
| KR | 2008-0001621 | U | 6/2008 |
| KR | 2015-0017105 | A | 2/2015 |
| KR | 2016-0012490 | A | 2/2016 |

* cited by examiner

CARTRIDGE PUMP

CROSS-REFERENCE TO RELATED APPLICATIONS

This application is a National Stage of International patent application PCT/KR2016/005546, filed on May 26, 2016, the disclosures of which is incorporated by reference in its entirety.

FIELD OF THE INVENTION

The present invention relates to a cartridge pump, and more specifically, to a cartridge pump which allows stored contents to be supplied to an inside of a container by rotation of a head unit.

BACKGROUND

Generally, dispensers are devices in which a gas, a liquid, or other contents included in a sealed container are discharged in a fixed quantity by pressure, and it is well known that dispensers have been applied to various sealed containers in which cosmetics, perfumes, medicines, foods, etc. are stored In a dispenser, when a button is pushed, a shaft moves down against an elastic force of a spring, and then contents included in a housing are discharged through a through-hole and a connection pipe. When the pressure on the button is released, the shaft moves up due to the elastic force of the spring and the through-hole is closed, and then the contents are blocked and the inside of the housing is in a vacuum state such that the contents stored in the container fill the housing.

When the button is repeatedly pushed, the above motions are repeated so that the contents included in the container are discharged.

A background technique of the present invention is disclosed in Korean Patent Publication No. 2005-0067805 (published on Jul. 5, 2005 and entitled "Device for proofing water caused by blocking inflowwater in pump dispenser").

The present invention is to provide a cartridge pump capable of supplying stored contents to an inside of a container by rotation of a head unit.

SUMMARY OF THE INVENTION

One aspect of the present invention provides a cartridge pump including: a housing unit connected to a container; a head unit rotatably provided in the housing unit; a storage unit provided in the head unit and having a storage space in which contents are stored; and a mixing operator configured to discharge the contents in the storage unit to the container in cooperation with an operation of the head unit.

The housing unit may include a housing body and a container connection cap rotatably provided at a circumference of the housing body and screw-coupled to the container to fix the housing body to the container.

The head unit may include a discharge head in which an outlet, through which a base in the container and the contents in the storage unit are discharged, is formed and a reception head configured to extend downward from the discharge head and receive the storage unit.

The discharge head may be provided with a cap member configured to cover the outlet and surround the discharge head.

An inside space in communication with the outlet may be formed in the discharge head, and a fixing member that extends to the inside space and is inserted into and engaged with the inside space is formed on the cap member.

The inside space and the fixing member may be formed to have a polygonal cross-sectional shape.

An opening and closing valve which opens or closes the outlet with movement of the storage unit may be provided in the storage unit.

The mixing operator may include a sealing cover configured to seal an inner space of the reception head, and a motion converter configured to convert a rotary movement of the head unit into a vertical movement of the storage unit such that the inner space of the reception head is unsealed.

A bottom surface of the sealing cover may form a plurality of partitioned spaces divided by barrier walls, and a top surface of the sealing cover may be formed in a convex shape.

The motion converter may include a vertical guide hole formed in a circumferential surface of the reception head, a guide protrusion formed on the storage unit to protrude to the outside of the vertical guide hole, and a spiral groove formed in the housing unit to receive the guide protrusion and configured to move the storage unit up or down along the vertical guide hole by rotation of the head unit.

The housing unit may be provided with an escape prevention unit configured to prevent the sealing cover from escaping when the sealing cover is separated therefrom.

In a cartridge pump according to the present invention, a storage unit in which contents are stored is unsealed in cooperation with rotation of a head unit so that the contents may be easily mixed with a base in a container. Accordingly, a beverage or a medicine can be easy to drink.

Additionally, in the present invention, since a base in a container and contents in a storage unit can be separately stored and mixed to drink immediately, physical property changes of the base and the contents can be avoided, and since the contents in the storage unit can be stored with a vacuum pressure, unintentional mixing of the base in the container and the contents can be avoided.

DETAILED DESCRIPTION

Figure 1:
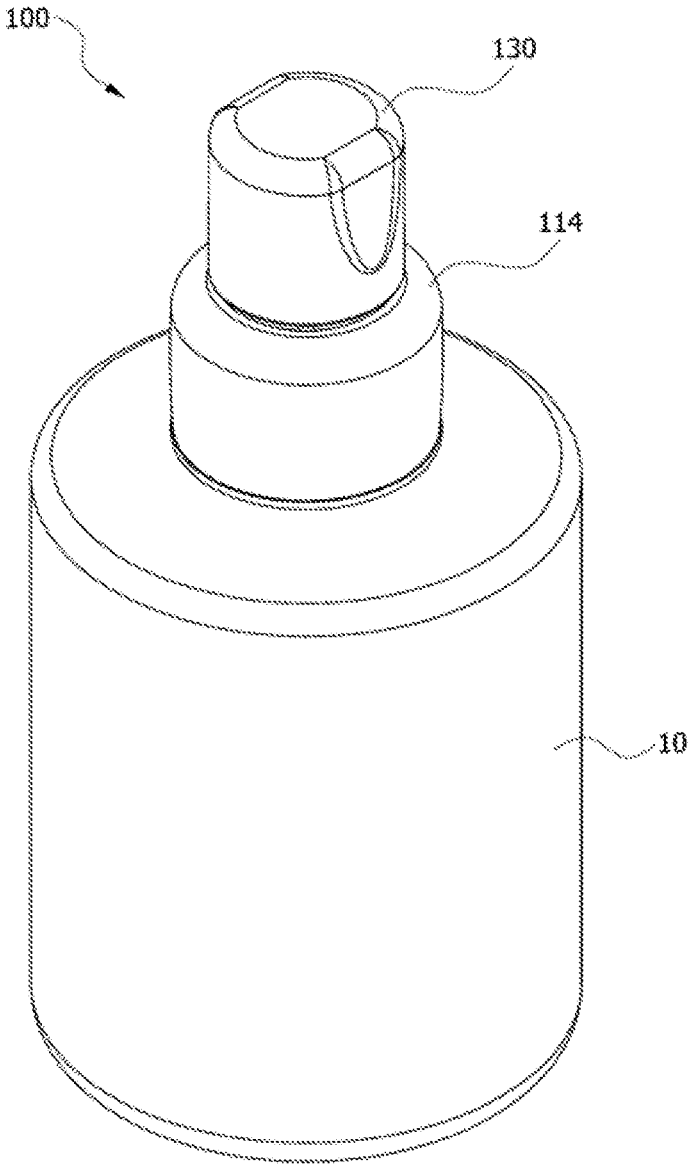
FIG. 1 is a perspective view of a cartridge pump according to one embodiment of the present invention.

Hereinafter, a cartridge pump according to one embodiment of the present invention will be described with reference to the accompanying drawings. Thicknesses of lines or sizes of components in the drawings may be exaggerated for clarity and convenience of explanation.

Additionally, some terms described below are defined in consideration of functions in the invention and meanings may vary depending on, for example, a user or operator's intentions or customs. Therefore, the meanings of terms should be interpreted based on the scope throughout this specification.

Figure 2:
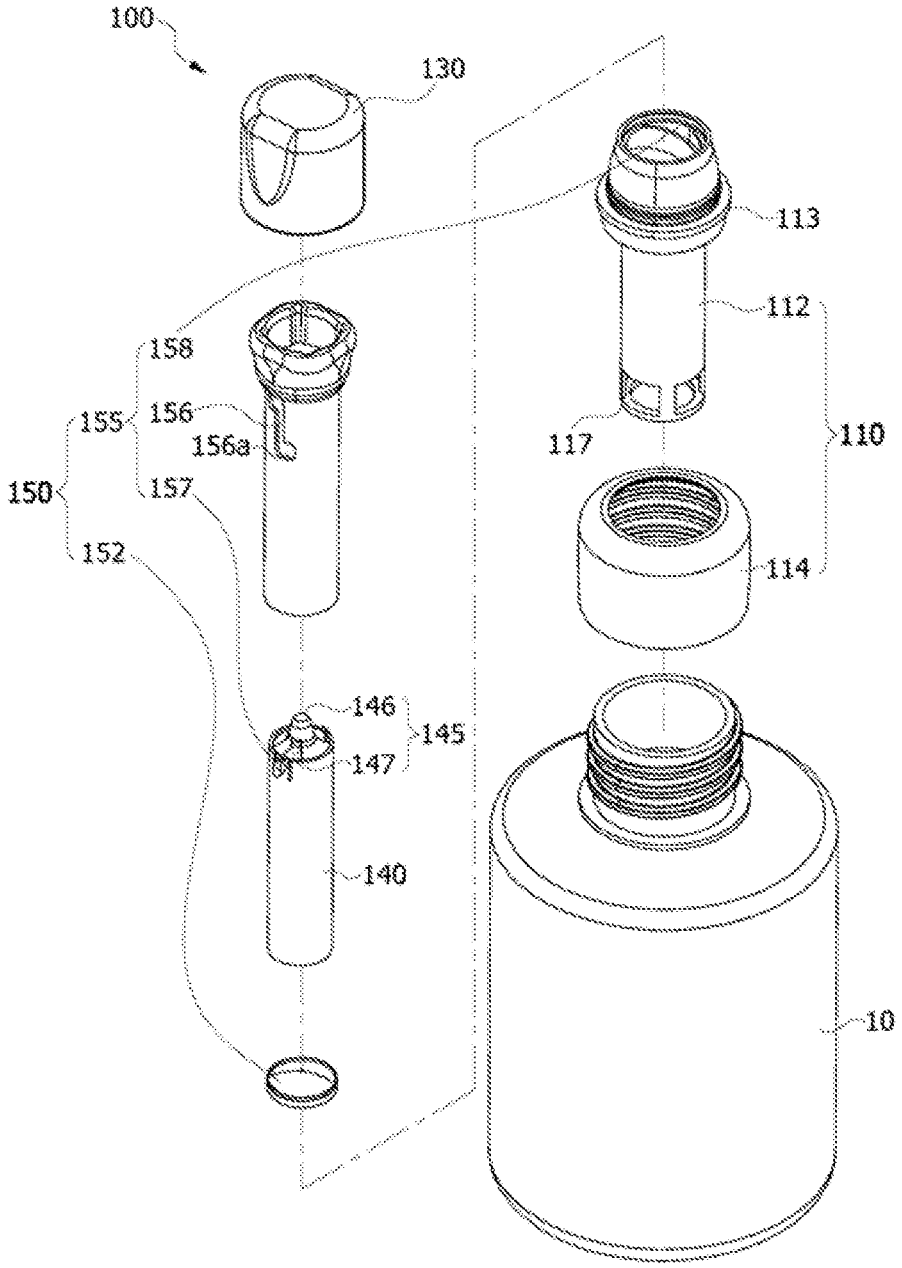
FIG. 2 is an exploded perspective view of the cartridge pump according to one embodiment of the present invention.
Figure 3:
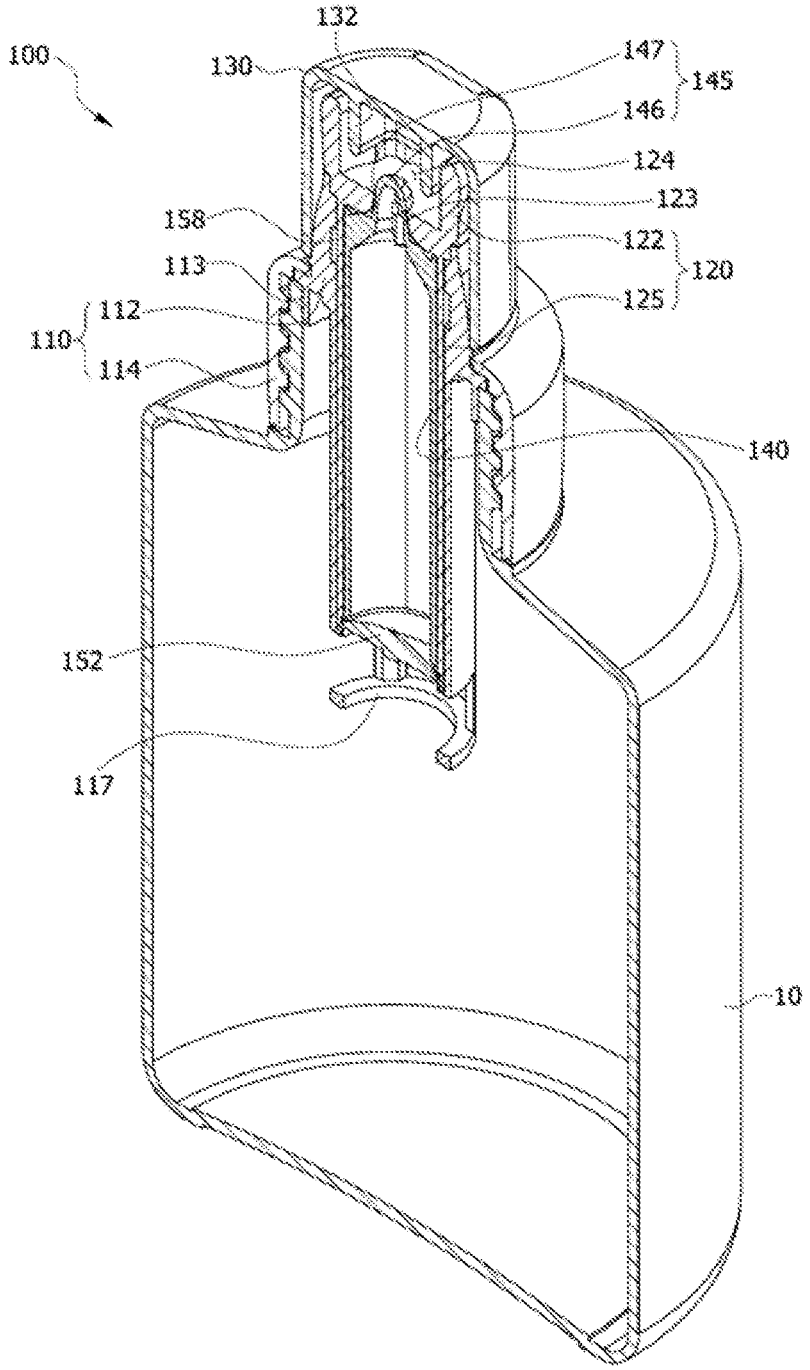
FIG. 3 is a cutaway perspective view of the cartridge pump according to one embodiment of the present invention.
Figure 4:
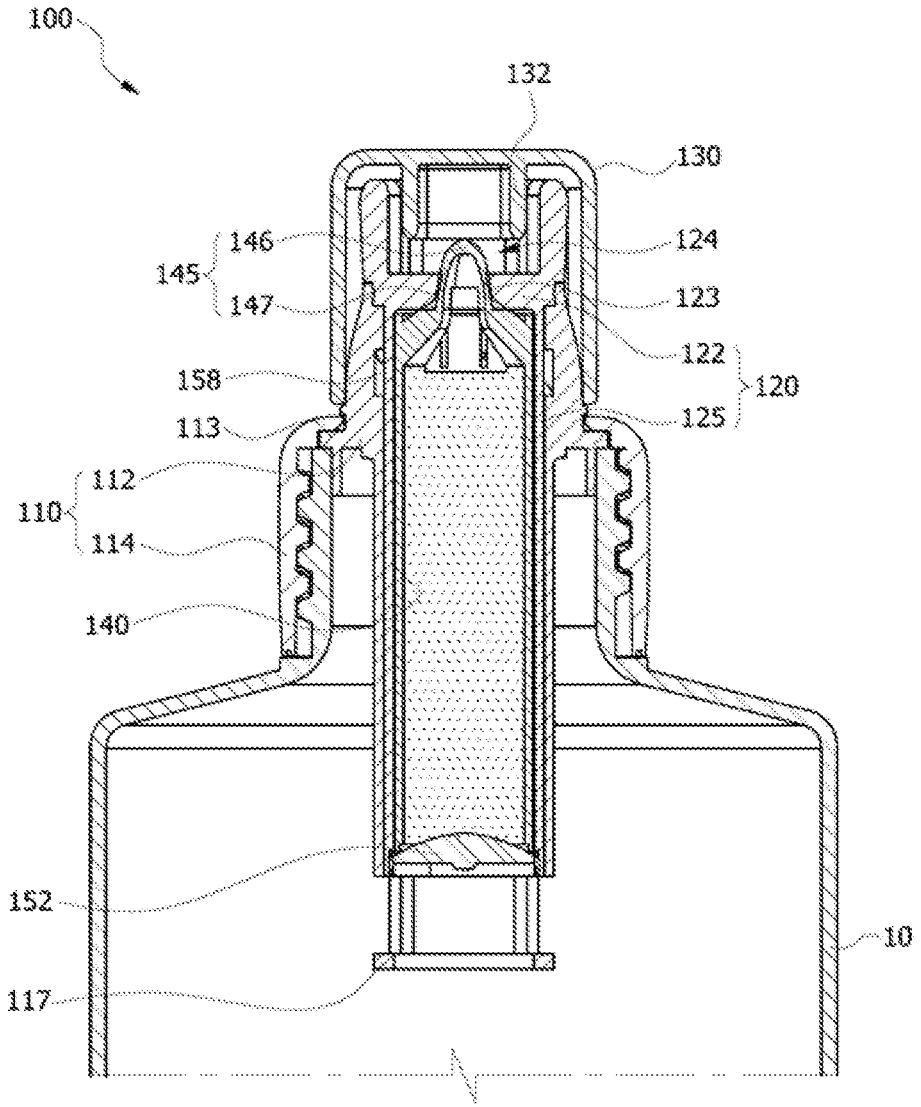
FIG. 4 is an exploded cutaway perspective view of the cartridge pump according to one embodiment of the present invention.
Figure 5:
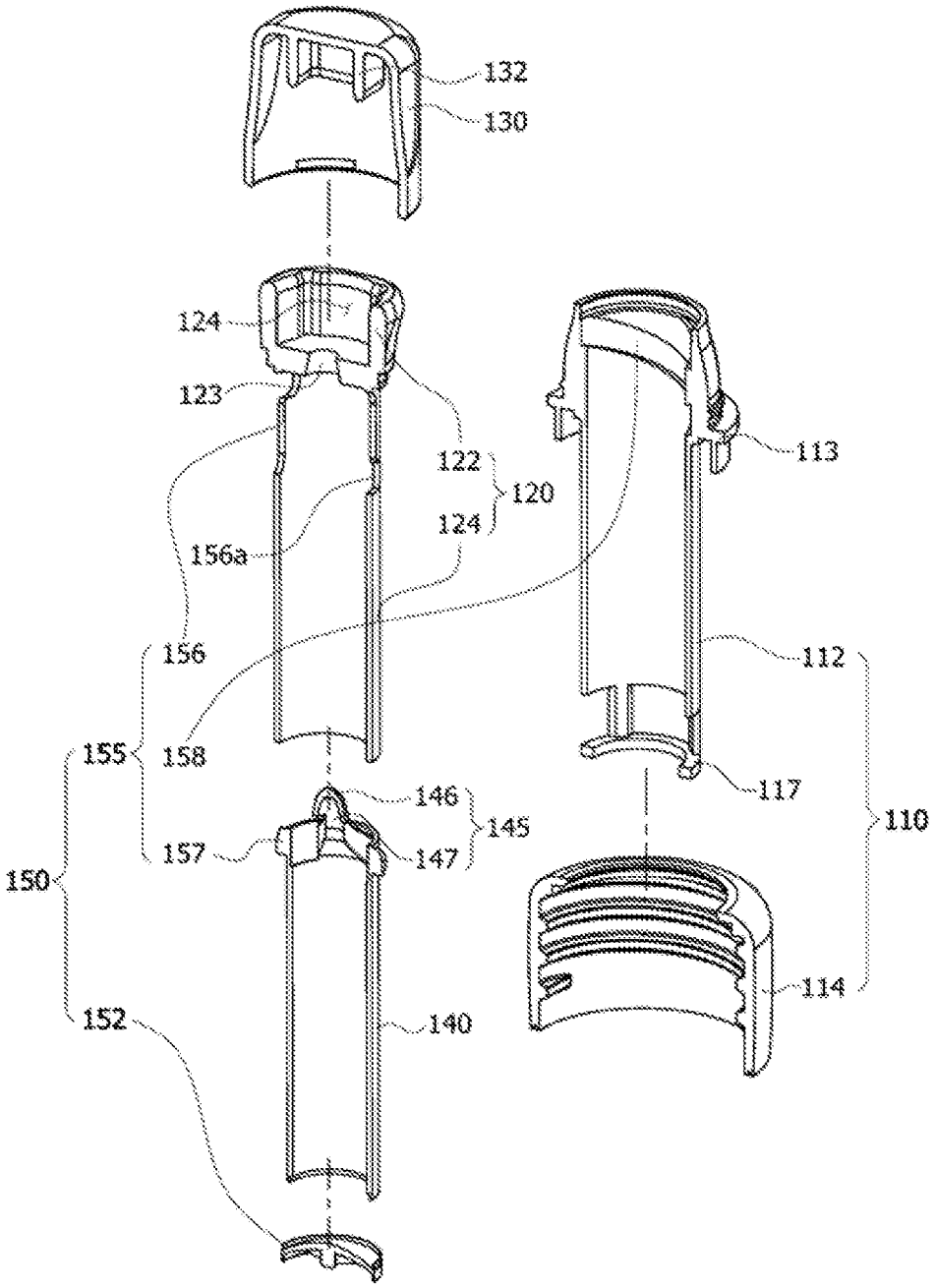
FIG. 5 is a cross-sectional view of the cartridge pump according to one embodiment of the present invention.
Figure 6:
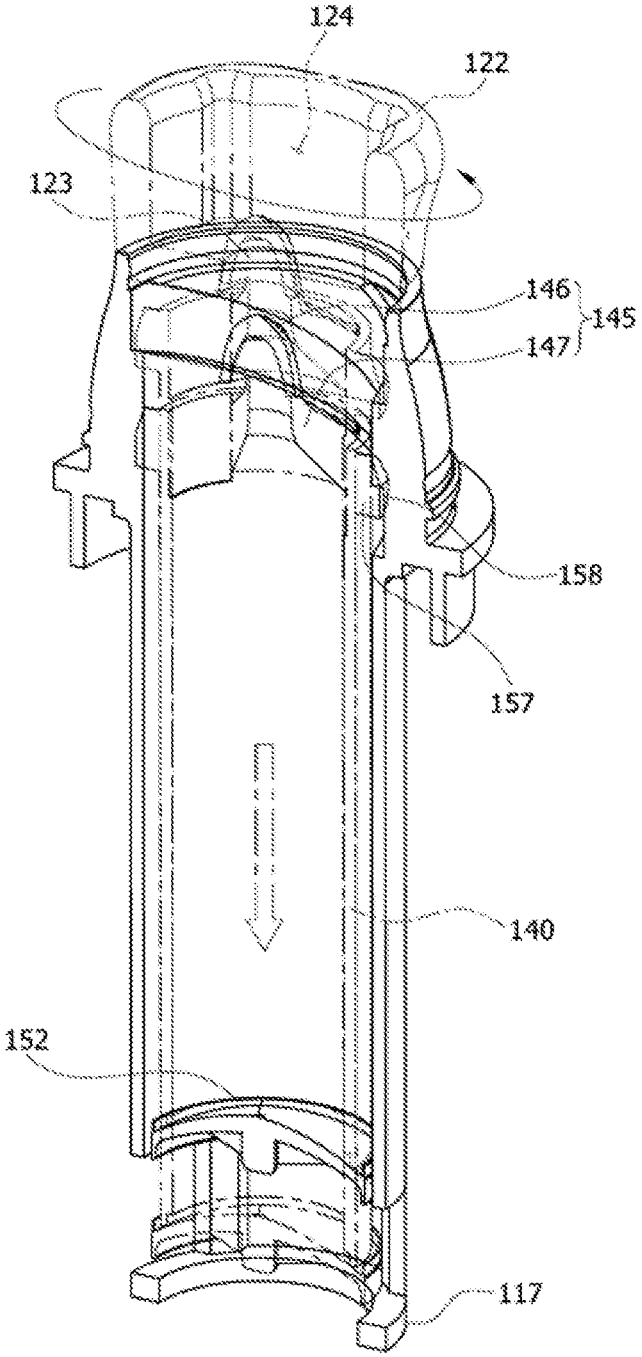
FIG. 6 is an operation view of a mixing operator of the cartridge pump according to one embodiment of the present invention.
Figure 7:
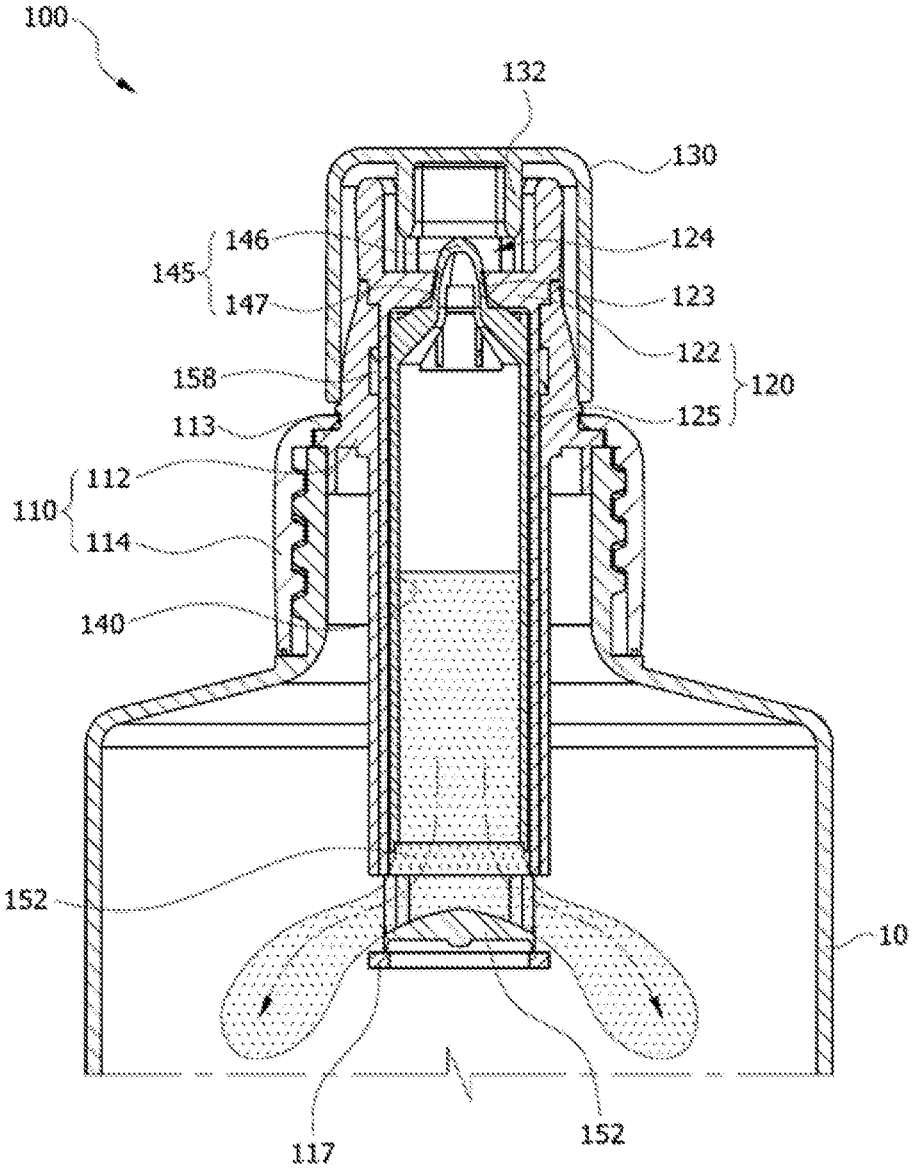
FIG. 7 is a view illustrating blocking of an outlet of the cartridge pump according to one embodiment of the present invention.

FIG. 1 is a perspective view of a cartridge pump according to one embodiment of the present invention, FIG. 2 is an exploded perspective view of the cartridge pump according to one embodiment of the present invention, FIG. 3 is a cutaway perspective view of the cartridge pump according to one embodiment of the present invention, FIG. 4 is an exploded cutaway perspective view of the cartridge pump according to one embodiment of the present invention, FIG. 5 is a cross-sectional view of the cartridge pump according to one embodiment of the present invention, FIG. 6 is an operation view of a mixing operator of the cartridge pump according to one embodiment of the present invention, and FIG. 7 is a view illustrating blocking of an outlet of the cartridge pump according to one embodiment of the present invention.

As illustrated in FIGS. 1 to 7, a cartridge pump 100 according to one embodiment of the present invention includes a housing unit 110, a head unit 120, a storage unit 140, and a mixing operator 150.

The housing unit 110 is connected to a container 10. More specifically, the housing unit 110 includes a housing body 112 and a container connection cap 114 rotatably provided at a circumference of the housing body 112 and screw-coupled to the container 10 to fix the housing body 112 to the container 10.

The housing body 112 is fixed to a front end of the container 10 by the container connection cap 114 and formed as a hollow so that a space capable of accommodating the head unit 120 and the storage unit 140 is formed.

A flange 113 is formed in the housing body 112 in which the container connection cap 114 is rotatably mounted. Additionally, the flange 113 is bent downward and inserted into an inlet of the container 10.

Screw threads are formed at an inner surface of the container connection cap 114 and screw-coupled to an outer surface of the inlet of the container 10 such that the housing body 112 is fixed. At a circumferential surface of the container connection cap 114, pleats may be formed to help gripping for rotation of the container connection cap 114.

The housing unit 110 has a space in which the head unit 120 and the storage unit 140 may be accommodated and may be formed in various shapes as long as the housing unit 110 is connected to the container 10.

The head unit 120 is rotatably provided in the housing unit 110. The head unit 120 includes a discharge head 122 in which an outlet 123, through which a base in the container 10 and contents in the storage unit 140 are discharged, is formed and a reception head 125 configured to extend downward from the discharge head 122 and accommodate the storage unit 140.

The discharge head 122 protrudes from an upper end of the housing unit 110, and the reception head 125 is provided inside the housing unit 110. In this case, the reception head 125 is formed in a pipe shape of which a diameter is less than an inner diameter of the housing unit 110. Further, an inside space 124 in communication with the outlet 123 is formed in the discharge head 122. In this case, a cap member 130 configured to cover the outlet 123 and surround the discharge head 122 is provided on the discharge head 122.

As illustrated in FIG. 4, a fixing member 132 that extends to the inside space 124 of the discharge head 122 and is inserted into and engaged with the inside space 124 is formed on the cap member 130. Accordingly, the outlet 123 of the discharge head 122 may be closed in a dual manner by an opening and closing valve 145 described below and the fixing member 132.

Further, the inside space 124 and the fixing member 132 are formed with a polygonal cross-sectional shape. This is a structure capable of rotating the head unit 120 while coupled with the cap member 130.

The storage unit 140 is provided in the head unit 120 and has a storage space in which the contents are stored. The storage unit 140 is formed in a pipe shape to correspond to a shape of the reception head 125, and the contents are stored therein. In this case, the contents may have various forms such as a liquid, a powder, etc.

The storage unit 140 is provided with an opening and closing valve 145 which opens or closes the outlet 123 by movement of the storage unit 140. As illustrated in FIGS. 3 and 4, the opening and closing valve 145 includes a blocking protrusion 146 which is convexly formed on an upper end of the storage unit 140 and a plurality of supporting ribs 147 which support the blocking protrusion 146 by connecting the blocking protrusion 146 and the storage unit 140 and are disposed separately from each other. In this case, the blocking protrusion 146 is formed to protrude upward in order to come in close contact with the outlet 123, and the outlet 123 is formed to become narrow toward an upper part thereof.

A mixing operator 150 discharges the contents included in the storage unit 140 to the container 10 in cooperation with an operation of the head unit 120. As illustrated in FIGS. 5 and 6, the mixing operator 150 includes a sealing cover 152 configured to seal an inner space of the reception head 125 and a motion converter 155 configured to convert a rotary movement of the head unit 120 into a vertical movement of the storage unit 140 such that the inner space of the reception head 125 is unsealed.

The storage unit 140 provided inside the reception head 125 moves down due to rotation of the head unit 120, and a lower part of the storage unit 140 pushes the sealing cover 152 such that the storage unit 140 is unsealed. Accordingly the contents are discharged into the container 10 through the lower part of the storage unit 140, and the base and the contents in the container 10 may be mixed.

The motion converter 155, which enables the above operation, includes a vertical guide hole 156 formed in a circumferential surface of the reception head 125, a guide protrusion 157 formed on the storage unit 140 to protrude to the outside of the vertical guide hole 156, and a spiral groove 158 formed in the housing unit 110 to receive the guide protrusion 157 and configured to move the storage unit 140 up or down along the vertical guide hole 156 by rotation of the head unit 120.

The vertical guide hole 156 is formed in a longitudinal direction of the reception head 125, and a locking hole **156*a* which is bent and extends in a direction corresponding to a rotation direction of the head unit 120 is formed in an end of the vertical guide hole 156. The locking hole 156*a* comes in contact with the guide protrusion 157 such that rotation of the head unit 120** may be limited and a user may recognize a range of rotation.

The sealing cover 152 covers a bottom surface of the reception head 125, and an edge of the sealing cover 152 is in close contact with an inner surface of a lower end of the reception head 125. A bottom surface of the sealing cover 152 forms a plurality of partitioned spaces divided by barrier walls, and an upper surface of the sealing cover 152 forms a convex shape. The sealing cover 152 may decrease a cost of materials and also reinforce structural rigidity.

Additionally, the housing unit 110 is provided with an escape prevention unit 117 configured to prevent the sealing cover 152 from escaping when the sealing cover 152 is separated therefrom. The escape prevention unit 117 is formed as an escape prevention ring which is connected with the housing unit 110 by connection ribs disposed separately from each other. Therefore, the sealing cover 152 separated from the reception head 125 may not fall inside the container 10 but may remain in the escape prevention unit 117. In this case, the contents stored in the storage unit 140 may be mixed with the base by spreading into the container 10 due to the convex upper surface of the sealing cover 152.

Hereinafter, a function and effect of the cartridge pump according to one embodiment of the present invention having the above structure will be described in detail.

Referring to FIG. 4, since the storage unit 140 is in a state in which the contents are stored therein, and the inside of the storage unit 140 is sealed, the contents are not discharged to an inside of the container 10. Further, the outlet 123 of the discharge head 122 is blocked by the opening and closing valve 145 formed at the upper part of the storage unit 140.

As described above, since the contents different from the base in the container 10 may be separately stored in the storage unit 140, physical property changes of the contents that may be caused by storing the contents for a long time in a state in which the contents are mixed with the base can be avoided.

Further, since the outlet 123 may be blocked in a dual manner by the opening and closing valve 145 and the fixing member 132 which is formed on the cap member 130 and engaged with the inside space 124 of the discharge head 122, performance of sealing may be improved.

Next, to summarize an operation state of the cartridge pump 100, as illustrated in FIGS. 5 and 6, when the cap member 130 is rotated, the head unit 120 is rotated because the fixing member 132 and the inside space 124 of the discharge head 122 are interconnected with a polygonal cross-sectional shape. Due to such rotation of the head unit 120, the storage unit 140 is moved down by the motion converter 155, and the storage unit 140 is unsealed by moving the storage unit 140 down so that the sealing cover 152 is separated from the reception head 125. Accordingly the contents stored in the storage unit 140 may fall into the container 10.

More specifically, when the cap member 130 is rotated while being gripped, the head unit 120 is rotated inside the housing unit 110, and the guide protrusion 157 of the storage unit 140, which protrudes outside the vertical guide hole 156 of the head unit 120, is moved down by the spiral groove 158 formed in an inner surface of the housing unit 110 along the vertical guide hole 156. Due to the operation of moving the storage unit 140 down, the outlet 123 opens, and at the same time a lower end of the storage unit 140 pushes the sealing cover 152 down, and then the inside of the storage unit 140 is unsealed so that the contents in the storage unit 140 are discharged to the inside of the container 10 and mixed with the base in the container 10 (refer to FIG. 7).

In this case, the locking hole 156*a* which is bent and extends in a direction corresponding to a rotation direction of the head unit 120 is formed in upper and lower ends of the vertical guide hole 156 and may limit a rotation section by bringing the guide protrusion 157 in contact with the locking hole 156*a*, and since the user may recognize the rotation, excessive rotation can be avoided.

Further, since the separated sealing cover 152 is mounted on the escape prevention unit 117, and the discharged contents are guided by being brought in contact with the convex upper surface of the sealing cover 152, the contents may fall over a wide area inside the container 10 and the contents can be easily mixed.

After this, the user may open the cap member 130 and drink a beverage or a medicine in which the contents in the storage unit 140 and the base in the container 10 are mixed.

When some of the beverage or medicine remains inside the container 10 after the user drinks it, the opening and closing valve 145 may block the outlet 123 because the storage unit 140 is moved up by connecting the cap member 130 for storage and then rotating the head unit 120 in an opposite direction.

As described above, in the cartridge pump according to the present invention, the storage unit storing contents is unsealed in cooperation with rotation of the head unit such that the contents may be easily mixed with the base in the container. Accordingly, a beverage or a medicine can be easy to drink. Additionally, since the base in the container and the contents in the storage unit can be separately stored and mixed to drink immediately, physical property changes of the base and the contents can be avoided, and since the contents in the storage unit can be stored with a vacuum pressure, unintentional mixing of the base in the container and the contents can be avoided.

While the invention has been described with reference to exemplary embodiments illustrated in accompanying drawings, these should be considered in a descriptive sense only, and it will be understood by those skilled in the art that various alterations and other equivalent embodiments may be made. Therefore, the scope of the invention is defined by the appended claims.

The invention claimed is:

1. A cartridge pump comprising:

a housing unit connected to a container;

a head unit rotatably provided in the housing unit;

a storage unit provided in the head unit and having a storage space in which contents are stored; and a mixing operator configured to lead the contents in the storage unit into the container in cooperation with an operation of the head unit, wherein the head unit comprises:

a discharge head in which an outlet, through which a base in the container and the contents in the storage unit are discharged, is formed; and a reception head configured to extend downward from the discharge head and receive the storage unit.

2. The cartridge pump of claim 1, wherein the housing unit comprises:

a housing body; and a container connection cap rotatably provided at a circumference of the housing body and screw-coupled to the container to fix the housing body to the container.

3. The cartridge pump of claim 1, wherein the discharge head is provided with a cap member configured to cover the outlet and surround the discharge head.

4. The cartridge pump of claim 3, wherein:

an inside space in communication with the outlet is formed in the discharge head; and a fixing member that extends to the inside space and is inserted into and engaged with the inside space is formed on the cap member.

5. The cartridge pump of claim 4, wherein the inside space and the fixing member are formed to have a polygonal cross-sectional shape.

6. The cartridge pump of claim 1, wherein the storage unit is provided with an opening and closing valve which opens or closes the outlet with movement of the storage unit.

7. The cartridge pump of claim 1, wherein the mixing operator comprises:

a sealing cover configured to seal an inner space of the reception head; and a motion converter configured to convert a rotary movement of the head unit into a vertical movement of the storage unit such that the inner space of the reception head is unsealed.

8. The cartridge pump of claim 7, wherein a bottom surface of the sealing cover forms a plurality of partitioned spaces divided by barrier walls, and a top surface of the sealing cover is formed to have a convex shape.

9. The cartridge pump of claim 7, wherein the motion converter comprises:

a vertical guide hole formed in a circumferential surface of the reception head;

a guide protrusion formed on the storage unit to protrude to the outside of the vertical guide hole; and a spiral groove formed in the housing unit to receive the guide protrusion and configured to move the storage unit up or down along the vertical guide hole by rotation of the head unit.

10. The cartridge pump of claim 8, wherein the housing unit is provided with an escape prevention unit configured to prevent the sealing cover from escaping when the sealing cover is separated therefrom.

* * * * *